US011187024B2

(12) United States Patent
Kalb et al.

(10) Patent No.: US 11,187,024 B2
(45) Date of Patent: Nov. 30, 2021

(54) DRIVE DEVICE FOR A WINDOW OPENER, WITH A BEARING STRUCTURE ON A CARRIER ELEMENT

(71) Applicant: BROSE FAHRZEUGTEILE GMBH & CO. KOMMANDITGESELLSCHAFT, BAMBERG, Bamberg (DE)

(72) Inventors: Roland Kalb, Rossach (DE); Gabriele Lange, Marktrodach (DE)

(73) Assignee: BROSE FAHRZEUGTEILE GMBH & CO. KOMMANDITGESELLSCHAFT, BAMBERG, Bamberg (DE)

( * ) Notice: Subject to any disclaimer, the term of this patent is extended or adjusted under 35 U.S.C. 154(b) by 282 days.

(21) Appl. No.: 16/331,073

(22) PCT Filed: Sep. 5, 2017

(86) PCT No.: PCT/EP2017/072274

§ 371 (c)(1),
(2) Date: Mar. 6, 2019

(87) PCT Pub. No.: WO2018/046506

PCT Pub. Date: Mar. 15, 2018

(65) Prior Publication Data

US 2019/0203519 A1 Jul. 4, 2019

(30) Foreign Application Priority Data

Sep. 6, 2016 (DE) ..... 102016216879.7

(51) Int. Cl.

| | |
|---|---|
| ***E05F 15/689*** | (2015.01) |
| ***E05F 11/48*** | (2006.01) |
| ***E05F 15/697*** | (2015.01) |

(52) U.S. Cl.
CPC ..... *E05F 15/689* (2015.01); *E05F 11/483* (2013.01); *E05F 15/697* (2015.01)

(58) Field of Classification Search
CPC .. E05F 15/689; E05F 11/483; E05Y 2900/55; E05Y 2201/654; E05Y 2201/664
See application file for complete search history.

(56) References Cited

U.S. PATENT DOCUMENTS

| | | | | |
|---|---|---|---|---|
| 4,367,660 A | 1/1983 | Becket et al. | | |
| 6,223,614 B1 * | 5/2001 | Takiguchi | ..... | F16H 55/14 464/92 |

(Continued)

FOREIGN PATENT DOCUMENTS

| | | |
|---|---|---|
| CN | 1310788 A | 8/2001 |
| CN | 1593967 A | 3/2005 |

(Continued)

*Primary Examiner* — Justin B Rephann
(74) *Attorney, Agent, or Firm* — Brooks Kushman P.C.

(57) ABSTRACT

It is provided a drive device for an adjustment installation for adjusting a vehicle part, in particular a power window actuator, comprising a carrier element; a cable drum; and a cable exit housing which is disposable on the carrier element and which mounts the cable drum so as to be rotatable about a rotation axis and which by way of at least one housing portion is attachable to the carrier element; and a motor unit for electromotively driving the cable drum. The carrier element has a contact structure having a plurality of elevations and depressions that are successively lined up and are mutually disposed in an alternating manner, the at least one housing portion of the cable exit housing by way of a base portion being attachable to the contact structure.

18 Claims, 14 Drawing Sheets

(56) References Cited

U.S. PATENT DOCUMENTS

| | | | | |
|---|---|---|---|---|
| 6,408,572 | B1 * | 6/2002 | Uchimura | E05F 11/485 464/92 |
| 6,629,905 | B1 * | 10/2003 | Sesselmann | E05F 11/483 254/344 |
| 8,176,679 | B2 * | 5/2012 | Klippert | E05F 11/483 49/352 |
| 2003/0160124 | A1 * | 8/2003 | Hemond | E05F 11/483 242/390.8 |
| 2005/0067521 | A1 * | 3/2005 | Klippert | E05F 15/697 242/390.8 |
| 2005/0241236 | A1 * | 11/2005 | Smith | E05D 13/1276 49/352 |
| 2006/0105877 | A1 * | 5/2006 | Bornchen | H02K 7/1004 475/149 |
| 2007/0163179 | A1 * | 7/2007 | Fukumura | H02K 7/116 49/360 |
| 2010/0043294 | A1 * | 2/2010 | Klippert | E05F 11/483 49/352 |
| 2019/0040668 | A1 * | 2/2019 | Muramatsu | E05F 11/483 |
| 2019/0203518 | A1 * | 7/2019 | Kalb | E05F 15/697 |
| 2019/0203519 | A1 * | 7/2019 | Kalb | E05F 15/689 |
| 2019/0218846 | A1 * | 7/2019 | Kalb | E05F 11/483 |
| 2019/0234130 | A1 * | 8/2019 | Kalb | E05F 15/697 |

FOREIGN PATENT DOCUMENTS

| | | | |
|---|---|---|---|
| DE | 102004044863 | A1 | 3/2006 |
| DE | 102005050750 | A1 | 5/2007 |
| DE | 202007007032 | U1 | 4/2008 |
| DE | 102009033472 | A1 | 1/2011 |
| EP | 1132236 | A2 | 9/2001 |
| EP | 1170452 | A1 | 1/2002 |
| EP | 1283323 | A1 | 2/2003 |
| EP | 2754829 | A1 | 7/2014 |
| WO | 2015111719 | A1 | 7/2015 |

* cited by examiner

2
X1
30
20
202
1
21
42
210
32
46
221
22
D
720
61
7
6
3
31
45
40
4
211
420
X2
220
722

1
2
3
4
6
7
20
21
22
31
32
40
42
46
61
202
210
211
220
420
720
722
D
X3

DRIVE DEVICE FOR A WINDOW OPENER, WITH A BEARING STRUCTURE ON A CARRIER ELEMENT

CROSS-REFERENCE TO RELATED APPLICATIONS

This application is the U.S. National Phase of PCT Application No. PCT/EP2017/072274, filed on Sep. 5, 2017, which claims priority to German Patent Application No. 10 2016 216 879.7, filed on Sep. 6, 2016, the disclosures of which are incorporated in their entirety by reference herein.

TECHNICAL FIELD

The disclosure relates to a drive device for an adjustment installation for adjusting a vehicle part, in particular a power window actuator.

BACKGROUND

Vehicles may include one or more drive devices to adjust a vehicle part. A drive device of this type may include a carrier element, a cable drum, and a cable exit housing which is disposable on the carrier element and which mounts the cable drum so as to be rotatable about a rotation axis and which by way of at least one housing portion is attachable to the carrier element. A motor unit serves for electromotively driving the cable drum.

A drive device of this type may include a carrier element, a cable drum, and a cable exit housing which may be disposed on the carrier element and which mounts the cable drum so as to be rotatable about a rotation axis and which by way of at least one housing portion is attachable to the carrier element. A motor unit serves for electromotively driving the cable drum.

The drive device may be a component part of a power window installation and can thus serve for adjusting a window glass. However, such a drive installation can also serve for adjusting another adjustment element, for example a sliding roof or the like, in a vehicle.

In the case of a power window actuator, one or a plurality of guide rails on which one entrainment element that is coupled to a window glass is in each case guided can be disposed in an apparatus carrier of a door module, for example. The entrainment element is coupled to the drive device by way of a flexurally limp traction cable which is conceived for transmitting (exclusively) tensile forces, wherein the traction cable is disposed on the cable drum in such a manner that the traction cable, in a rotating movement of the cable drum, by way of one end is wound onto the cable drum and by way of another end is unwound from the cable drum. A displacement of a cable loop formed by the traction cable thus takes place in a manner corresponding to a movement of the entrainment element along the respectively assigned guide rail. The window glass, driven by the drive device, can thus be adjusted so as to release or close a window opening on a door on the side of a vehicle, for example.

SUMMARY

It is an object underlying the proposed solution to make available a drive device which is particularly simple to assemble and when in operation can have a favorable operational behavior.

One or more objects may be achieved by a subject matter having features as described herein.

Accordingly, the carrier element has a contact structure having a plurality of elevations and depressions that are successively lined up and are mutually disposed in an alternating manner. The at least one housing portion of the cable exit housing by way of a base portion is attachable to the contact structure.

For example, the contact structure can extend annularly about the rotation axis on the carrier element, wherein the elevations and depressions are successively lined up in an alternating circumferential manner about the rotation axis. The elevations and depressions herein may form a periodically encircling structure having radially extending peaks and troughs.

The contact structure can in particular extend annularly about an opening in the carrier element, the cable drum by way of said opening in terms of gearing being connected to the motor unit.

On account of depressions and elevations being successively lined up in an alternating manner, a structure is produced on the carrier element which, on the one hand, causes a reinforcement where the cable exit housing is attached to the carrier element is achieved there on the carrier element. On the other hand, by attaching the cable exit housing to the contact structure by way of one or a plurality of housing portions, the cable exit housing can be disposed in a rotationally fixed and advantageously play-free manner on the carrier element, such that that an advantageous position of the cable exit housing on the carrier element results by way of a fixed connection between the cable exit housing and the carrier element.

The contact structure by way of the elevations and depressions thereof that are successively lined up in an alternating manner can configure, for example, a corrugated structure in which the elevations are formed by corrugation peaks, and the depressions are formed by corrugation troughs. The elevations and depressions herein are advantageously successively lined up in a uniform manner, this enabling the cable exit housing to be attached to the carrier element in various positions, specifically in those positions that are mutually rotated about the rotation axis.

The corrugated structure on the carrier element may be formed by a corrugated design at a non-variable thickness of the carrier element. On account of the corrugated shaping of the carrier element in the region of the contact structure, material accumulations can be avoided in this way, this being able to minimize any distortion and thus reduce deviations from a nominal shape (which otherwise could lead to an out-of-round running and thus to a generation of noise when in operation).

In order for a favorable position of the cable exit housing to be obtained on the carrier element, the base portion can have a profile that is complementary to that of the contact structure of the carrier element, for example. Accordingly, the base portion can have elevations and/or depressions that are complementary to the elevations and depressions, for example, such that the base portion can be attached in a planar manner to the support element so as to bear in a positive-locking manner on the contact structure.

For example, the base portion can have one or a plurality of depressions which can be inserted into one or a plurality of elevations of the contact structure. The base portion can likewise have one or a plurality of depressions which can receive one or a plurality of elevations of the contact structure.

The base portion, in terms of the shaping thereof, is thus adapted to the contact structure. A plurality of different discrete positions in which the cable exit housing can be attached to the contact structure results.

The base portion herein can have a substantially rigid shape such that the base portion when attached to the contact structure if at all deforms only to a minor extent.

In one alternative variant, the base portion can at least in portions be elastic such that the base portion, when attaching the cable exit housing to the carrier element, can be elastically deformed. The base portion in this variant is not mandatorily pre-shaped so as to be complementary to the contact structure. The base portion can also adapt to the contact structure by way of an elastic deformation only when the cable exit housing is being attached to the carrier element, thus attaining a position on the contact structure that is fixed in a positive-locking manner by way of the base portion.

When the base portion is at least in portions elastic, damping in relation to vibrations can also be provided during operation by way of said base portion. The base portion in this case acts in a damping manner between the cable exit housing and the carrier element.

If the base portion is to be elastically deformed when the cable exit housing is being attached to the carrier element, it can be provided that the housing portion is configured from a plurality of materials so as to design the housing portion to be softer in particular in the region of the base portion and to thus enable an elastic deformation on the base portion. To this end, it can be provided that the housing portion in a first region is made from a first material having a first elasticity modulus and in a second region, in particular in the region of the base portion, is made from a second material having a lower, second elasticity modulus. The housing portion in the region of the base portion can in this way be designed so as to be softer, thus more elastic, such that a deformation can take place in particular in the region of the base portion when the cable exit housing is being attached to the contact structure of the carrier element.

The elasticity modulus (also referred to as tensile modulus, coefficient of elasticity, elongation modulus, E modulus, or Young's modulus), is understood to be a material indicator which describes the correlation between tension and elongation in the deformation of a solid body when behaving in a linear-elastic manner. The higher the elasticity modulus, the more rigid the material.

Establishing the cable exit housing in a rotationally fixed manner on the carrier element can already be performed by attaching the cable exit housing by way of one or a plurality of housing portions to the contact structure of the carrier element. Additionally, one or a plurality of positive-lock elements which are radially spaced apart from the rotation axis and which (for engaging in positive-lock openings on the base portions of the housing portions of the cable exit housing) are molded on the carrier element, for example, or (for engaging in positive-lock openings on the carrier element) are molded on the base portions of the housing portion can be provided for securing the cable exit housing in a rotational manner in relation to the carrier element.

In one concrete design embodiment the positive-lock element is disposed on the carrier element and projects so as to be parallel to the rotation axis from the contact structure. When attaching the cable exit housing to the carrier element, the positive-lock element comes to engage with a positive-lock opening on a base portion of a housing portion such that an (additional) positive lock along a stress direction that is directed about the rotation axis is formed in this way between the cable exit housing and the carrier element.

The positive-lock element herein, when attaching the cable exit housing to the carrier element, can latch in the positive-lock opening such that a captive retention of the cable exit housing on the carrier element is achieved by way of the positive-lock element. This can be particularly helpful in the assembly so as to prevent the cable exit housing from falling off the carrier element after said cable exit housing has been attached to the latter.

The positive-lock opening can be formed by an arcuate slot opening, for example. Accordingly, the positive-lock element is configured as a projecting arcuate rib.

The base portion by way of the positive-lock opening can in particular be separated from other regions of the housing portion of the cable exit housing, on account of which the elasticity on the base portion can be set in a desired manner, for example. In order for the deformation capability of the base portion to be increased, it can be provided herein, for example, that the slot-shaped positive-lock opening on the housing portion runs so far that said positive-lock opening also extends into side walls of the housing portion that extend from the base portion. On account of this separation of the base portion, for example from a rear wall of the housing portion, the base portion can adapt in an elastic manner to the shaping of the contact structure when the cable exit housing is attached to the carrier element.

The drive device may include a drive housing which is disposed on a side of the carrier element that faces away from the cable drum housing and which mounts a drive wheel which in terms of gearing is connected to a motor unit. The cable exit housing advantageously has a first bearing element for mounting the cable drum, and the drive housing has a second bearing element for mounting the drive wheel. In one design embodiment herein, the cable exit housing and the drive housing are fastened to one another by way of a fastening element which acts between the first bearing element and the second bearing element.

A very simple assembly results on account of the cable exit housing on one first side of the carrier element, and the drive housing on the other, second side of the carrier element, being fastened to one another and therefore being established on the carrier element by way of a (single) fastening element which acts between the first bearing element and the second bearing element. For assembly, the cable exit housing, on the one hand, and the drive housing, on the other hand, can in particular be attached to the carrier element so as to thereafter connect the cable exit housing and the drive housing to one another, such as mutually brace in an axial manner said cable exit housing and said drive housing, by way of the fastening element, for example a screw element.

For example, in the case of an arrangement according to the intended use on a vehicle, the cable drum is disposed on a door on the side of the vehicle, for example in a wet space, while the motor unit of the drive device lies in a dry space. The separation between the wet space and the dry space herein can be provided by the carrier element, for example an apparatus carrier, made of plastics, of a door module. Such a wet space/dry space separation can be maintained in a simple manner on account of the assembly of the cable exit housing on the one side of the carrier element and of the drive housing on the other side of the carrier element, and on account of the connection by way of a (single) central fastening element, without said wet space/dry space separation being compromised by fastening elements that engage from one side to the other.

The first bearing element serves for mounting the cable drum and to this end can for example be configured as a cylindrical bearing dome which projects from a base of the cable exit housing. Moreover, the second bearing element of the drive housing, which serves for mounting the drive wheel on the side of the carrier element that faces away from the cable drum, can be configured as a cylindrical bearing dome on the drive housing. The bearing domes are axially mutually braced by way of the fastening element, such that the cable exit housing, on the one hand, and the drive housing, on the other hand, are established on the carrier element by way of said bracing.

In order to ensure that the first bearing element of the cable exit housing and the second bearing element of the drive housing are attached to one another in a positionally correct manner when assembling, one of the bearing elements may have a conical portion (a so-called centering cone) while the other bearing element has a centering engagement which can be configured, for example, by a conical opening. When the cable exit housing is attached to the carrier element, on the one hand, and the drive housing is attached to the carrier element, on the other hand, the conical portion and the entering engagement come to mutually engage such that the first bearing element of the cable exit housing and the second bearing element of the drive housing are mutually centered and it is ensured that the first bearing element of the cable exit housing and the second bearing element of the drive housing are aligned so as to be mutually coaxial.

In an embodiment, the center-aligning engagement between the conical portion, on the one hand, and the centering engagement, on the other hand, can be established only when bracing during the assembly, for example. It can thus be provided that, in a first assembly position in which the cable exit housing and the drive housing are disposed on the carrier element but are not yet mutually axially braced by way of the fastening element, the conical portion and the centering engagement have mutual axial play. The conical portion and the centering engagement in the first assembly position thus do not directly bear on one another. Conical area portions of the conical portion, on the one hand, and of the centering engagement, on the other hand, have in particular not yet slid onto one another. In a second assembly position, in which the cable exit housing and the drive housing are mutually axially braced by way of the fastening element, the conical portion and the centering engagement do however bear on one another. The play between the first bearing element and the second bearing element, as existed in the first assembly position, is thus eliminated in the second assembly position. The first bearing element and the second bearing element are mutually centered on account of the conical portion and the centering engagement bearing on one another.

In the bracing of the cable exit housing in relation to the drive housing by way of the fastening element that is configured as a screw element, for example, it can be provided that the cable exit housing is elastically deformed in one region or in a plurality of regions. Any play between the cable exit housing, the carrier element, and the drive housing, as well as any play in the mounting of the cable drum, can be equalized on account of such a deformation capability.

Such an elastic deformation capability can be made available by way of a targeted shaping on portions of the cable exit housing. Such an elastic deformation capability can be provided, for example, on the base of the cable exit housing from which the first bearing element projects. The base herein is connected to the carrier element by way of the at least one housing portion which is radially spaced apart from the first bearing element of the cable exit housing, such that the base lies away from the carrier element and the cable drum is received within the cable exit housing.

One or a plurality of structural elements for reinforcing the base can be provided on the base, for example. Reinforcement ribs which extend radially in relation to the rotation axis, or circumferentially about the rotation axis, can thus be molded on the base. One or a plurality of said reinforcement ribs can be interrupted in portions, in that recesses are provided on the assigned reinforcement ribs, such that a material weakening which enables an (elastic) deformation of the base specifically at this location is achieved at said recesses in order for a predetermined breaking point to be achieved on the base herein.

BRIEF DESCRIPTION OF THE DRAWINGS

The concept on which the solution is based is to be explained in more detail hereunder by means of the exemplary embodiments illustrated in the figures.

DETAILED DESCRIPTION

A drive installation device may generally be designed so as to make available a torque of sufficient strength in order for the window glass to be adjusted. The drive device herein is to be able to have a small installation space, is to be easily assembled for example on an assigned carrier element, for example the apparatus carrier of a door module, and when in operation is to have a favorable operational behavior together with a low generation of noise, for example on a door module of a vehicle door.

In the case of a drive for an adjustment installation in a motor vehicle, known from DE 10 2004 044 863 A1, a cable drum is disposed on a bearing dome of a drive housing, wherein the drive housing by way of a fastening element in the form of a screw is connected to a carrier element in the form of an apparatus carrier.

In the operation of the drive device, the cable drum which is mounted in the cable exit housing is rotated by way of the motor unit so as to move a traction cable that is disposed on the cable drum. The cable exit housing herein is to be established in a rotationally fixed manner on the carrier element such that torques that act by way of the cable drum on the cable exit housing do not lead to any movement of the cable exit housing. The cable exit housing herein is to be established in an ideally play-free manner on the carrier element, wherein any vibration excitation of the carrier element by way of the cable exit housing should moreover be minimized.

FIGS. 1A, 1B to 9 show a first exemplary embodiment of a drive device 1 which can be used, for example, as a drive in an adjustment device for adjusting a window glass, for example of a side door of a vehicle.

Figure 12:
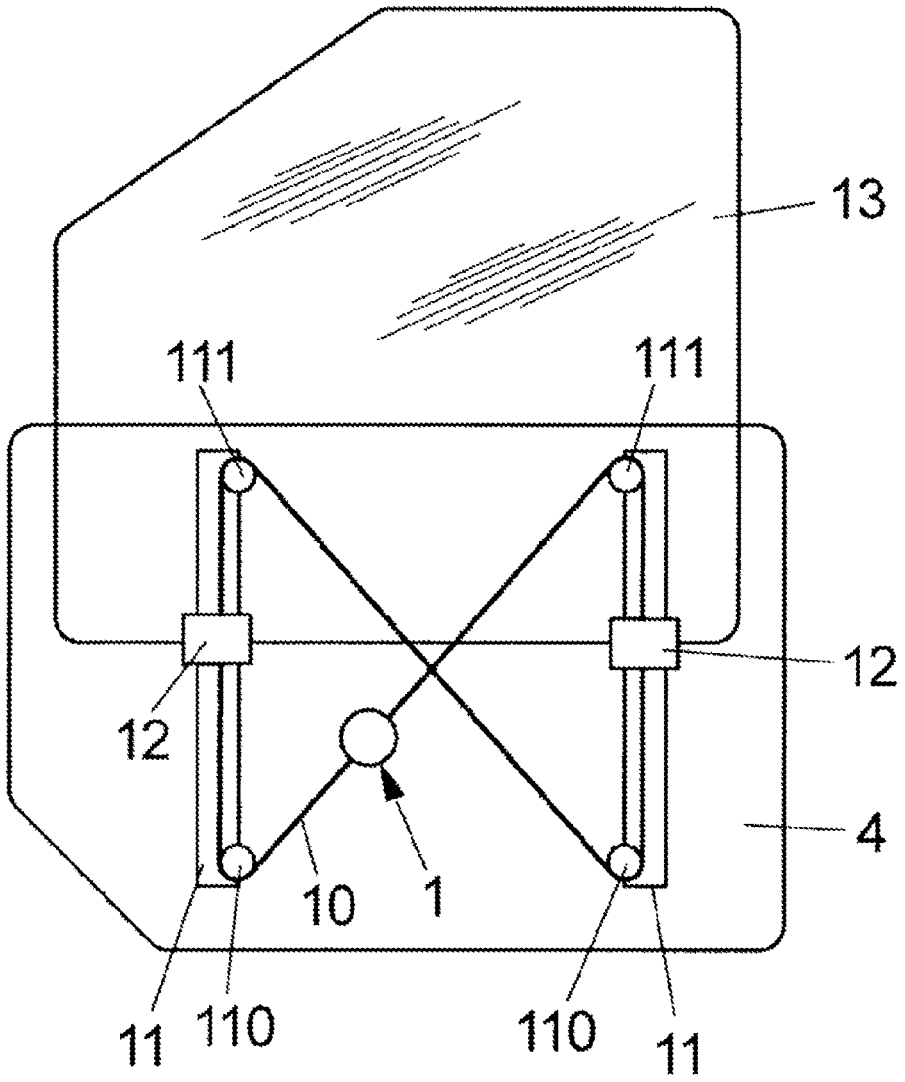
FIG. 12 shows a schematic view of an adjustment installation of a vehicle in the form of a power window actuator.
Figure 13A:
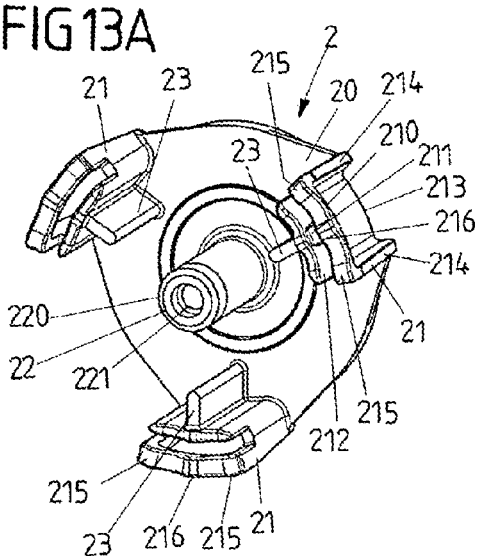
FIG. 13A shows a view of an exemplary embodiment of the cable exit housing.
Figure 13B:
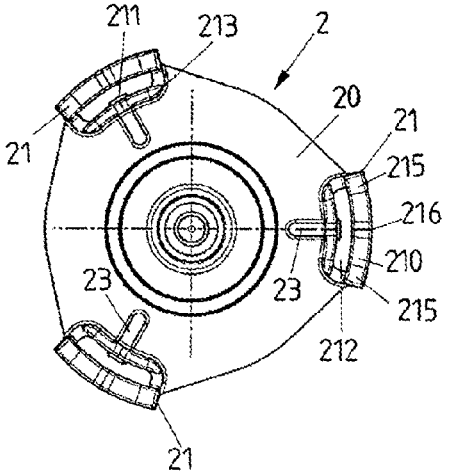
FIG. 13B shows a view of the cable exit housing from below.
Figure 13C:
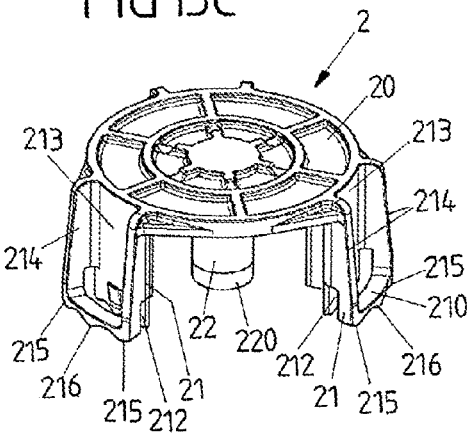
FIG. 13C shows a perspective view of the cable exit housing from obliquely above.
Figure 13D:
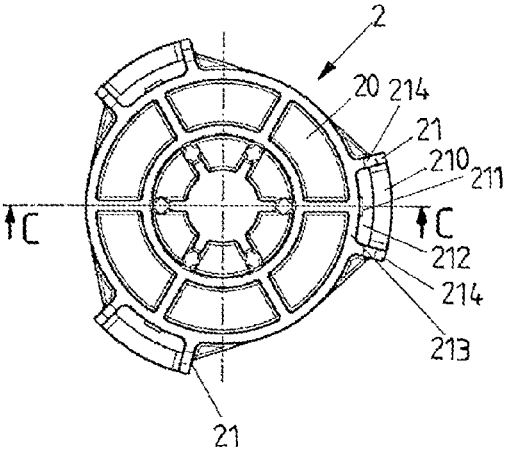
FIG. 13D shows a view of the cable exit housing from above.
Figure 13E:
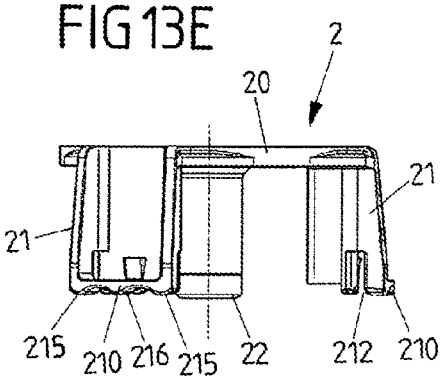
FIG. 13E shows a side view of the cable exit housing.
Figure 13F:
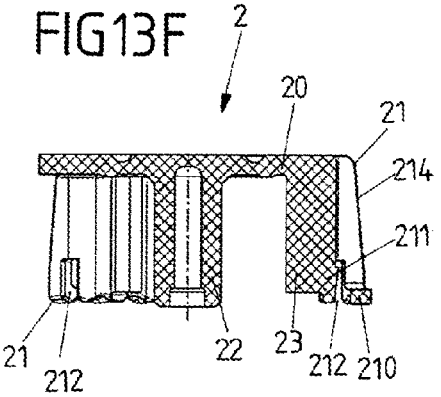
FIG. 13F shows a sectional view along the line C-C according to FIG. 13D.

Such an adjustment device in the form of a power window actuator, illustrated in an exemplary manner in FIG. 12, has a pair of guide rails 11, for example, on which one entrainment element 12 which is coupled to a window glass 13 is in each case adjustable. Each entrainment element 12 is coupled to a drive device 1 by way of a traction cable 10 which is configured for transmitting (exclusively) tensile forces, wherein the traction cable 10 configures a closed cable loop and to this end, by way of the ends of said traction cable 10, is connected to a cable drum 3 (cf. FIGS. 1A and 1B, for example) of the drive device 1. The traction cable 10 extends from the drive device 1 around deflection rollers 110 on the lower ends of the guide rails 11 to the entrainment elements 12, and from the entrainment elements 12 around deflection rollers 111 at the upper ends of the guide rails 11 back to the drive device 10.

When in operation, a motor unit of the drive device 1 drives the cable drum 3 in such a manner that the traction cable 10 by way of one end is wound onto the cable drum 3, and by way of the other end is unwound from the cable drum 3. On account thereof, the cable loop formed by the traction cable 10 is displaced without any change in the freely extended cable length, this leading to the entrainment elements 12 being moved in the same direction on the guide rails 11 and the window glass 13, on account thereof, being adjusted along the guide rails 11.

The power window actuator in the case of the exemplary embodiment according to FIG. 12 is disposed on an apparatus carrier 4 of a door module. The apparatus carrier 4 can, for example, be established on an internal door panel of a vehicle door and represents a pre-assembled unit which, in the pre-assembled state having the power window actuator disposed on the apparatus carrier 4, can be assembled on the vehicle door.

The drive device 1 of the exemplary embodiment according to FIGS. 1A, 1B to 9 is disposed on an area portion 40 of a carrier element 4 which is implemented, for example, by an apparatus carrier and which has a cable exit housing 2 disposed on a first side of the carrier element 4, and a drive housing 7 disposed on a second side of the carrier element 4, said second side facing away from the first side. The cable exit housing 2 serves for mounting the cable drum 3 on the carrier element 4, while the drive housing 7 encloses inter alia a drive wheel 6 which can be driven by way of a motor unit 8 and is connected to the cable drum 3 such that the cable drum 3 can be driven by rotating the drive wheel 6.

The cable drum 3 on the first side of the carrier element 4, when disposed according to the intended use on a vehicle door of a vehicle, for example, is disposed in a wet space of the vehicle door. By contrast, the drive housing 7 is located in the dry space of the vehicle door. The separation between the wet space and the dry space is established by way of the carrier element 4, and the interface between the drive wheel 6 and the cable drum 3 is accordingly to be sealed in a moisture-proof manner such that no moisture can make its way from the wet space to the dry space.

The cable exit housing 2 has a base 20, a cylindrical bearing element 22 in the form of a bearing dome that projects centrally from the base 20, and housing portions 21 in the form of housing webs which extend so as to be parallel to the cylindrical bearing element 22 and are radially spaced apart from the bearing element 22. The cable drum 3 is rotatably mounted on the bearing element 22 and herein is enclosed by the cable exit housing 2 in such a manner that the cable drum 3 is held on the carrier element 4.

The cable drum 3 has a body 30 and, on the circumferential shell face of the body 30, has a cable channel 300 for receiving the traction cable 10, said cable channel 300 being molded in the body 30. The cable drum 3 by way of a ring gear 31 is inserted in an opening 41 of the carrier element 4 and is connected in a rotationally fixed manner to the drive wheel 6 such that a rotating movement of the drive wheel 6 leads to a rotating movement of the cable drum 3.

The drive housing 7 by way of an interposed sealing element 5 is attached to the other, second side of the carrier element 4 and has a housing case 70 having a bearing element 72 in the form of a cylindrical bearing dome which is configured centrally in said housing case 70 and which engages through an opening 62 of the drive wheel 6 and which in this way rotatably mounts the drive wheel 6. A worm housing 74 adjoins the housing case 70, a drive worm 81 which is connected in a rotationally fixed manner to a drive shaft 800 of an electric motor 80 of the motor unit 8 lying in said worm housing 74 and by way of a worm toothing meshing with an external toothing 600 of a body 60 of the drive wheel 6. The drive shaft 800, at the end thereof that faces away from the electric motor 80, by way of a bearing 82 is mounted in the worm housing 74. The electric motor 80 herein lies in a motor case 73 of the drive housing 7, said motor case 73 by way of a housing cover 75 being closed in relation to the outside.

The drive housing 7 moreover has an electronics housing 76 in which a circuit board 760 having control electronics disposed thereon is enclosed. The electronics housing 76 is closed in relation to the outside by way of a housing plate 761 having a plug connector 762 for the electrical connection of the electronics of the circuit board 760 disposed on said housing plate 761.

The drive wheel 6, so as to project axially from the body 60, has a connecting wheel 61 having an external toothing 610 molded thereon, said connecting wheel 61 engaging with the ring gear 31 of the cable drum 3 in such a manner that an internal toothing 310 of the ring gear 31 (cf. FIG. 1B, for example) connects in a meshing manner with the external toothing 610 of the connecting wheel 61. The drive wheel 6 and the cable drum 3 are in this way connected in a rotationally fixed manner to one another such that the cable drum 3 is rotatable on the carrier element 4 by driving the drive wheel 6.

In order for the drive device 1 to be assembled, the cable exit housing 2 is attached to the carrier element 4, on the one hand, and the drive housing 7 is attached to the carrier element 4, on the other hand. The fastening to the carrier element 4 is in this instance performed in that a fastening element 9 in the form of a screw element is inserted into an engagement opening 721 on the lower side of the drive housing 7 in such a manner that the fastening element 9 extends through an opening 720 in the bearing element 72 of the drive housing 7 (cf. FIG. 9) and engages centrally in an opening 221 within the bearing element 22 of the cable exit housing 2. The cable exit housing 2 and the drive housing 7 by way of the fastening element 9 are mutually axially braced on the bearing elements 22, 72 and are moreover established on the carrier element 4.

A thread for receiving the fastening element 9 can be molded within the opening 221 of the bearing element 22 of the cable exit housing 2. However, it is also conceivable and possible for the fastening element 9 to be screwed into the opening 221 in a self-tapping manner.

For assembly, the cable exit housing 2 is attached to the first side of the carrier element 4 such that the cable exit housing 2 encloses the cable drum 3 and holds the latter on the carrier element 4 as is illustrated in FIGS. 2 to 4A, 4B. The cable exit housing 2 herein, as is yet to be explained in detail herein by means of FIGS. 13 to 19, by way of the housing portions 21 thereof that are radially spaced apart from the bearing element 22, by way of base portions 210 comes to bear on a contact structure 45 in the form of a contact ring which circumferentially surrounds an opening 41 in the carrier element 4.

Axially projecting positive-lock elements 42 in the form of web-shaped pins are configured on the contact structure 45, said positive-lock elements 42, when attaching the cable exit housing 2 to the carrier element 4, engaging with positive-lock openings 212 (cf. FIG. 4B) on the base portions 210 of the housing portions 21, and in this way achieving an anti-rotation safeguard about the rotation axis D between the cable exit housing 2 and the carrier element 4, said rotation axis D being defined by the bearing element 22.

The web-shaped positive-lock elements 42, when viewed along the circumferential direction about the bearing element, on the lateral edges thereof can extend in an oblique manner (at a minor angle) such that the housing portions 21 when plug-fitting the base portions 210 onto the positive-lock elements 42 are established on the positive-lock elements 42 so as to be free of play along the circumferential direction.

Figure 6:
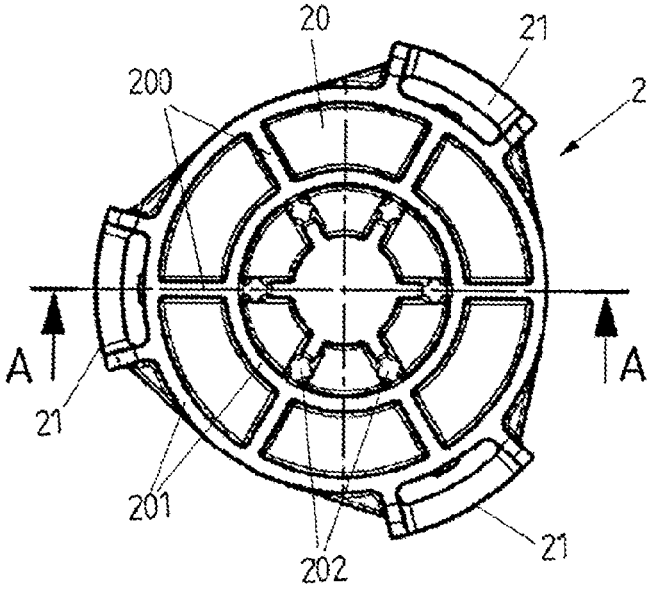
FIG. 6 shows a plan view of the cable exit housing.
Figure 7:
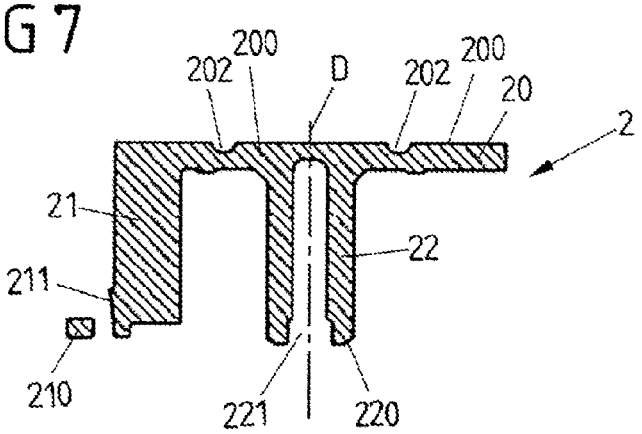
FIG. 7 shows a cross-sectional view along the line A-A according to FIG. 6.
Figure 8:
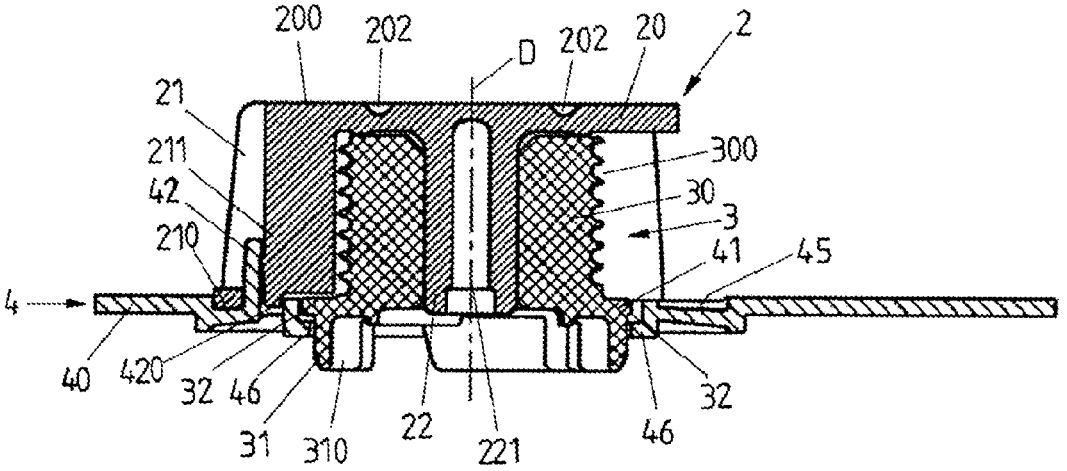
FIG. 8 shows the cross-sectional view according to FIG. 7, with the cable exit housing attached to the carrier element.

Latching clearances 420 (cf. FIG. 1A, for example) in which latching elements 211 in the form of outwardly projecting latching cams on the housing portions 21 engage in the case of an attached cable exit housing 2 are provided on the internal side of the positive-lock elements 42, as can be seen, for example, by comparing FIGS. 6 to 8. The cable exit housing 2, conjointly with the cable drum 3 enclosed therein, is held on the carrier element 4 in a pre-assembly position by way of said latching connection, even when the drive housing 7 is not yet braced in relation to the cable exit housing 2 by way of the fastening element 9. The latching connection thus simplifies the assembly and prevents the cable exit housing 2 from falling off in the case of an as yet unassembled drive housing 7.

The cable drum 3 in the pre-assembly position, by way of radially projecting bearing elements 32 on the upper periphery of the ring gear 31 (cf. FIG. 1A, for example) comes to bear on a bearing ring 46 within the opening 41 of the carrier element 4 (cf. FIG. 8, for example), such that the cable drum 3 in the pre-assembly position cannot slip through the opening 41 and is held on the carrier element 4 by way of the cable exit housing 2.

The bearing elements 32 serve in particular for securing the position of the cable drum 3 on the carrier element 4 in the pre-assembly position. Upon complete assembly of the drive device 1 the cable drum 3 is connected to the drive wheel 6 by way of the ring gear 31 and is axially established between the cable exit housing 2 and the drive housing 7.

Axially extending securing elements 23 that project in a radially inward manner are disposed on the internal sides of the housing portions 21, said securing elements 23 facing the cable channel 300 on the shell face of the body 30 and when in operation, sliding along the shell face. It is ensured by way of said securing elements 23 that the traction cable 10 received in the cable channel 300 cannot jump out of the cable channel 300.

Figure 1A:
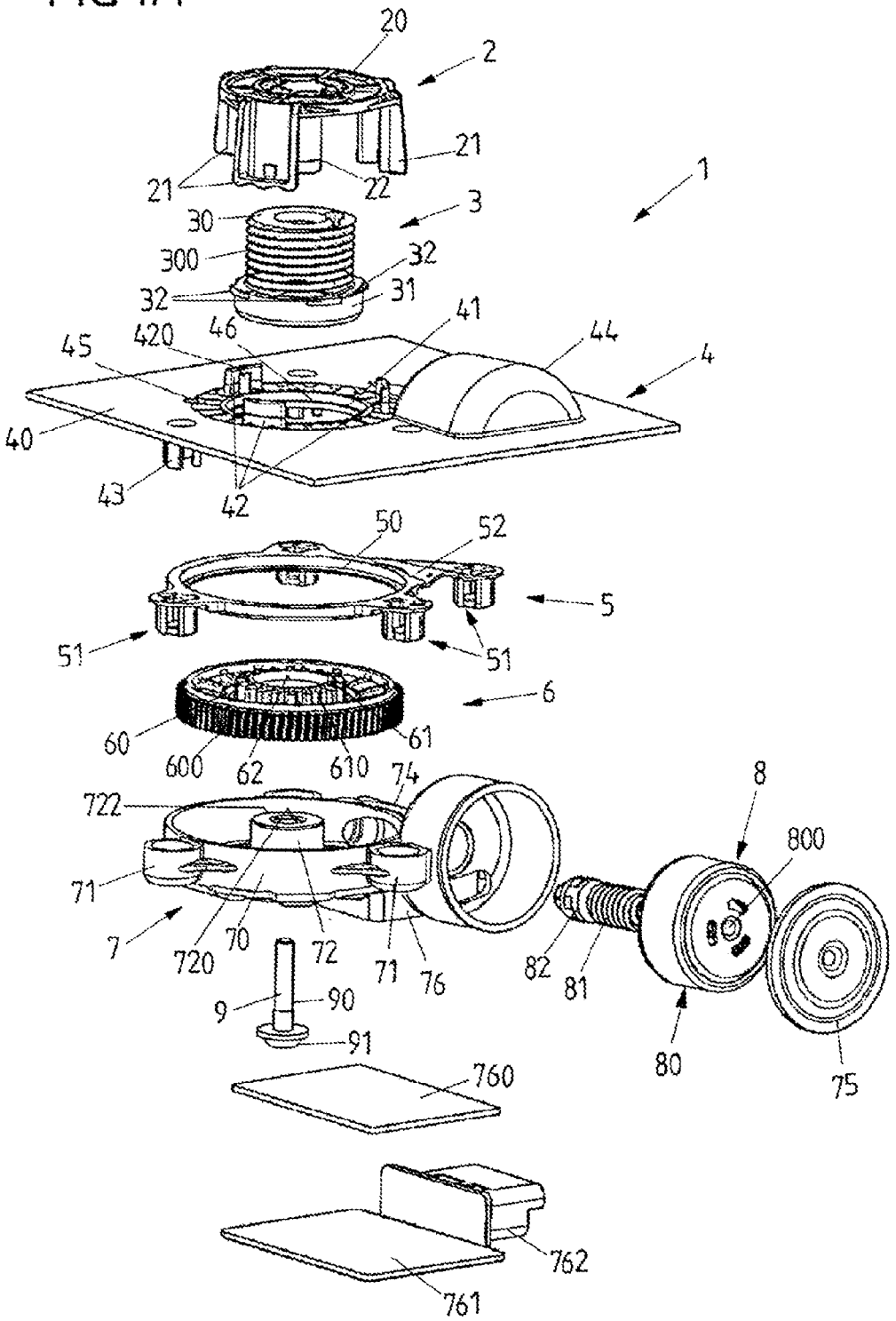
FIG. 1A shows an exploded view of an exemplary embodiment of a drive device.
Figure 1B:
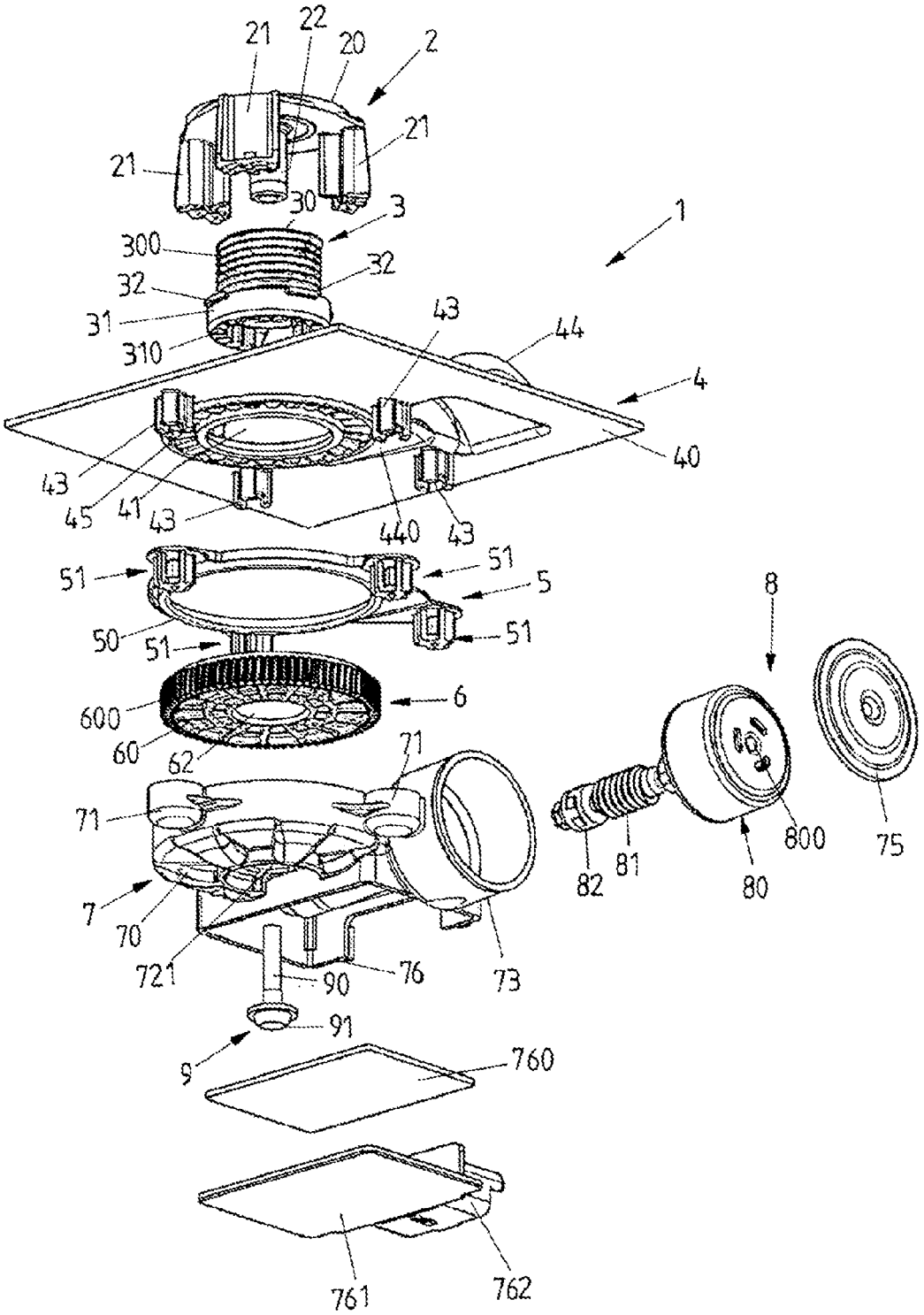
FIG. 1B shows the exploded view according to FIG. 1A from a different perspective.
Figure 2:
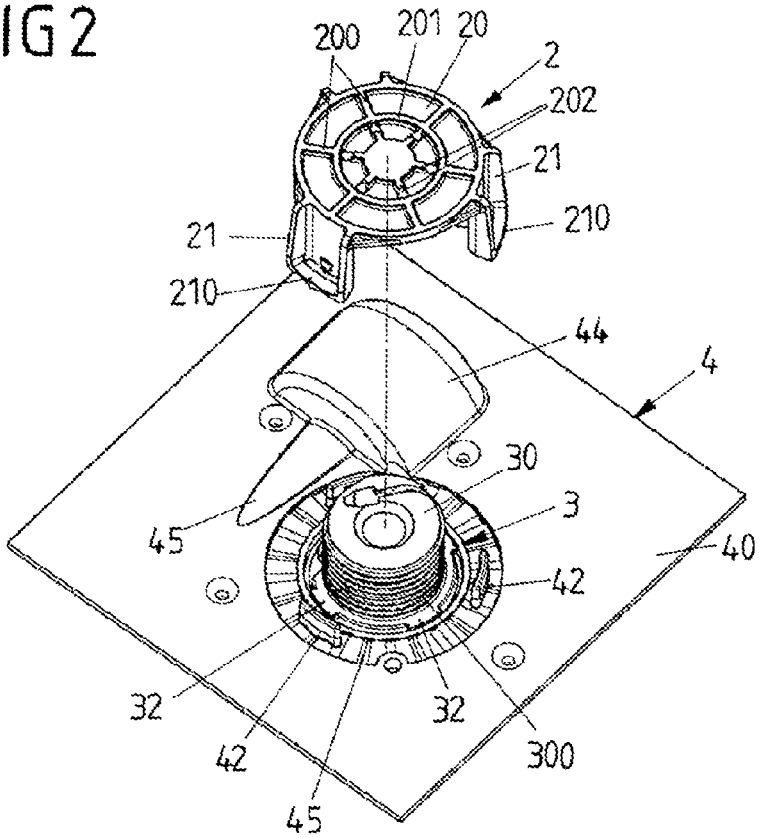
FIG. 2 shows a view of a cable exit housing before being attached to a carrier element.
Figure 3:
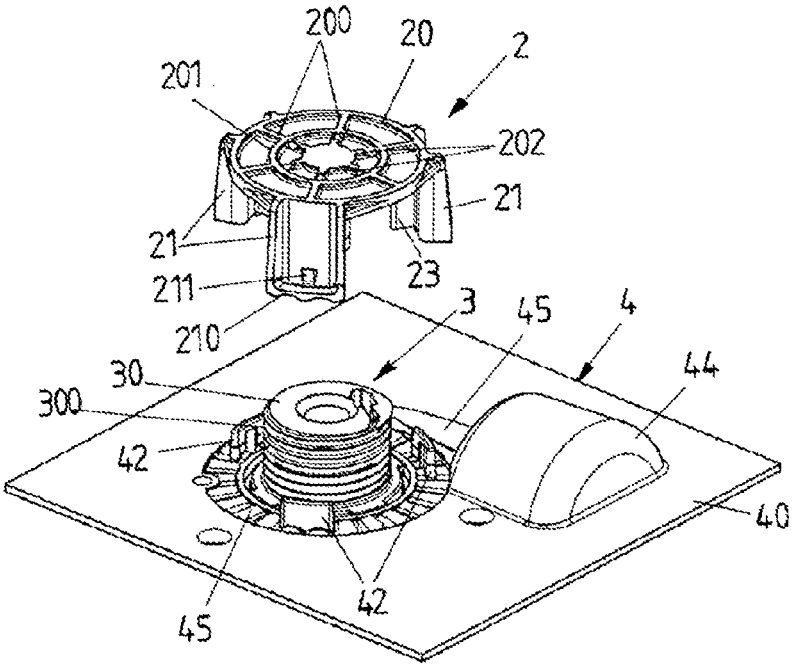
FIG. 3 shows another view of the cable exit housing before being attached to the carrier element.
Figure 4A:
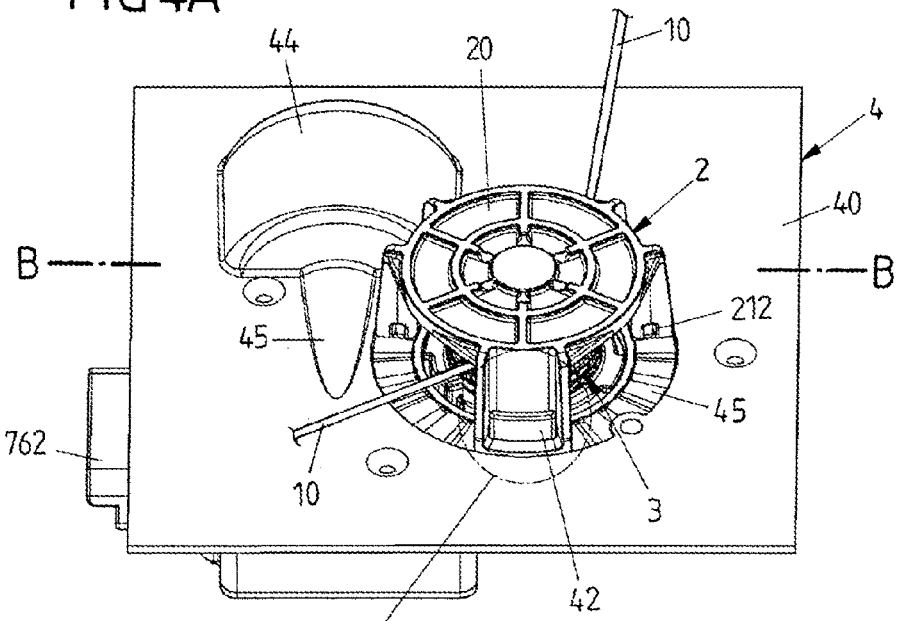
FIG. 4A shows a view of the cable exit housing on the carrier element.
Figure 4B:
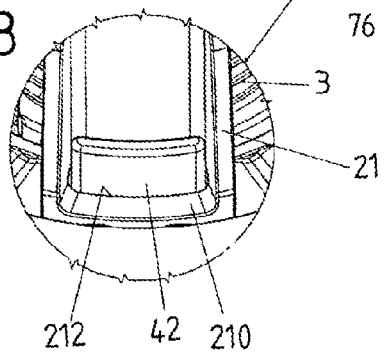
FIG. 4B shows a view enlarged in fragments of the assembly according to FIG. 4A.
Figure 5:
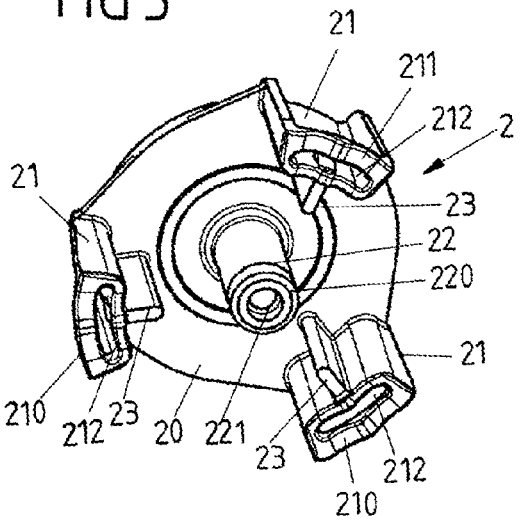
FIG. 5 shows a dedicated view of the cable exit housing seen from obliquely below.

The drive housing 7 is attached to the other, second side of the carrier element 4 in such a manner that the motor case 73 comes to lie in a molding 44 in the area portion 40, and the worm housing 74 comes to lie in a molding 440 in the area portion 40 that is adjacent to said molding 44 (cf. FIGS. 1A, 1B and 2). Fastening installations 71 in the form of engagement bushes having positive-lock openings 710 molded therein engage with positive-lock elements 43 in the form of pins projecting from the lower side of the carrier element 4 when the drive housing 7 is attached. On account of the positive-lock openings 710 of the fastening installations 71, exactly like the positive-lock elements 43 in the form of the pins on the carrier element 4, are radially spaced apart from the rotation axis D defined by the bearing element 72 of the drive housing 7, the drive housing on account of said positive-locking engagement is established in a rotationally fixed manner on the carrier element 4 such that an anti-rotation safeguard for the drive housing 7 is provided.

Engagement portions 51 are disposed on an annular seal 50 of the sealing element 5 on the positive-lock elements 43 of the carrier element 4, such that the positive-locking engagement of the positive-lock elements 43 in the positive-lock openings 710 on the fastening installations 71 is performed with the intervention of the engagement portions 51. This serves for the acoustic decoupling.

A curved portion 52 which comes to lie in the region of the molding 440 for receiving the worm housing 74 is configured on the sealing element 5. The curved portion 52 forms an intermediate layer between the worm housing 74 and the carrier element 4 such that an acoustic decoupling of the drive housing 7 from the carrier element 4 is achieved.

Figure 9:
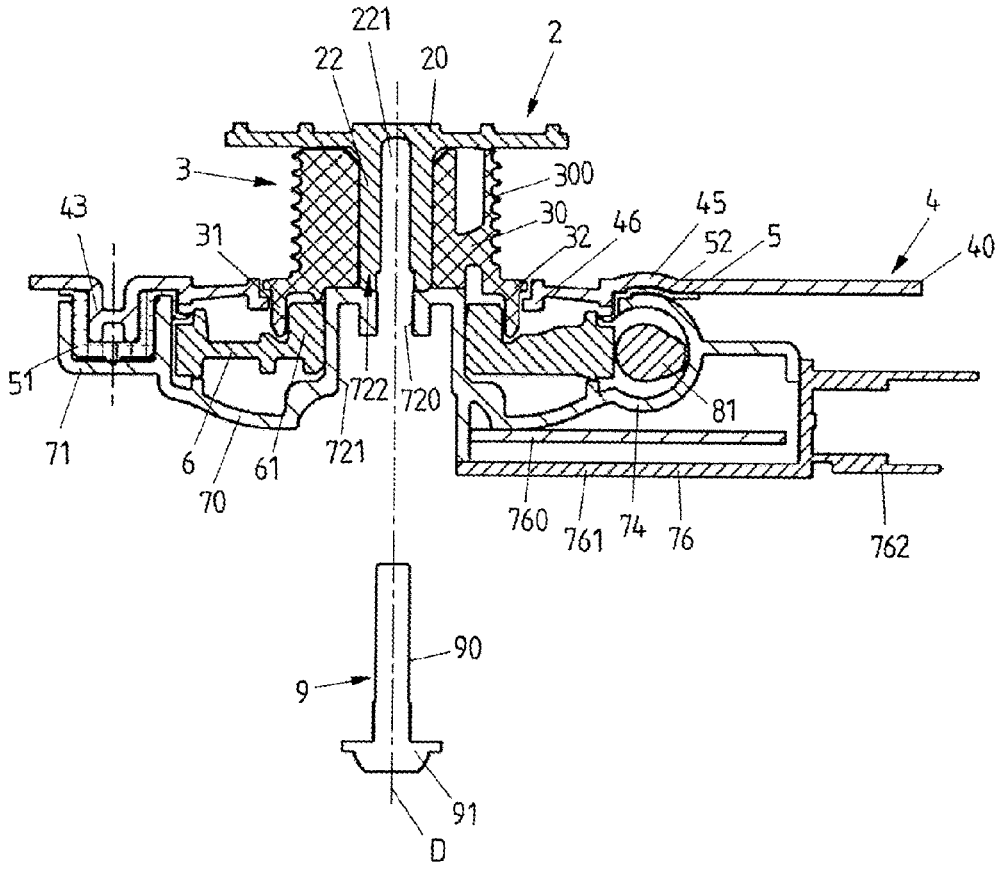
FIG. 9 shows a cross-sectional view along the line B-B according to FIG. 4A, before the bracing of the cable exit housing with a drive housing by way of a fastening element.

When the drive housing 7 has been attached to the carrier element 4 with the intervention of the sealing element 5, the drive housing 7 by way of the fastening element 9 is braced in relation to the cable exit housing 2 such that the cable exit housing 2 and the drive housing 7 thereby are mutually established and established on the carrier element 4. As is illustrated in FIG. 9, the fastening element 9 is inserted into the engagement opening 721 within the bearing element 72 of the drive housing 7 such that the fastening element 9 by way of a shank 90 engages through the opening 720 at the head of the bearing element 72 and engages in the opening 221 of the bearing element 22 of the cable exit housing 2. A head 91 of the fastening element 9 herein comes to lie on the side of the opening 720 that faces away from the bearing element 22 such that the cable exit housing 2 is braced in relation to the drive housing 7 by screwing the fastening element 9 into the opening 221 within the bearing element 22.

As can be seen from FIGS. 2 and 6, for example, the cable exit housing 2 on the base 20 thereof on the side that faces away from the carrier element 4 has structural elements 200, 201 in the form of reinforcement ribs which extend radially in relation to the rotation axis D defined by the bearing element 22, or extend circumferentially about the rotation axis D, and reinforce the base 20. Local recesses 202 for weakening the material on the structural elements 200 are achieved herein in the radially extending structural elements 200, said recesses 202 being disposed along a ring about the rotation axis D and achieving a predetermined breaking line for the elastic deformation of the base 20.

When the fastening element 9 is screwed into the bearing elements 22 from the side of the drive housing 7, the base 20 can thus be at least slightly deformed such that production-related tolerances can be equalized and the cable exit housing 2 by way of the base portions 210 on the housing portions 21 is established in a play-free manner on the carrier element 4.

The bearing element 22 on an end that faces away from the base 20 moreover has a conical portion 220 in the form of a centering cone (cf. FIGS. 8 and 9) which when bracing the cable exit housing 2 in relation to the drive housing 7 engages in a centering engagement, shaped in a complementary manner, on the bearing element 72 of the drive housing 7, and in this way sets a centered position of the bearing element 22 of the cable exit housing 2 in relation to the bearing element 72 of the drive housing 7. Both, the conical portion 220 on the end of the bearing element 22 as well as the centering engagement 722 on the head of the bearing element 72, are conically shaped and herein are mutually complementary (the conical portion 220 implements an external cone, while the centering engagement 722 represents an internal cone) such that the bearing element 22 of the cable exit housing 2 in the event of an engagement is aligned so as to be centered in relation to the bearing element 72 of the drive housing 7.

The bearing element 22 of the cable exit housing 2 and the bearing element 72 of the drive housing 7 herein define a common rotation axis D for the cable drum 3, on the one hand, and for the drive wheel 6, on the other hand, such that the cable drum 3 and the drive wheel 6 when in operation can rotate in a mutually coaxial and conjoint manner.

Figures 10A, 10B, 10C, 10D:
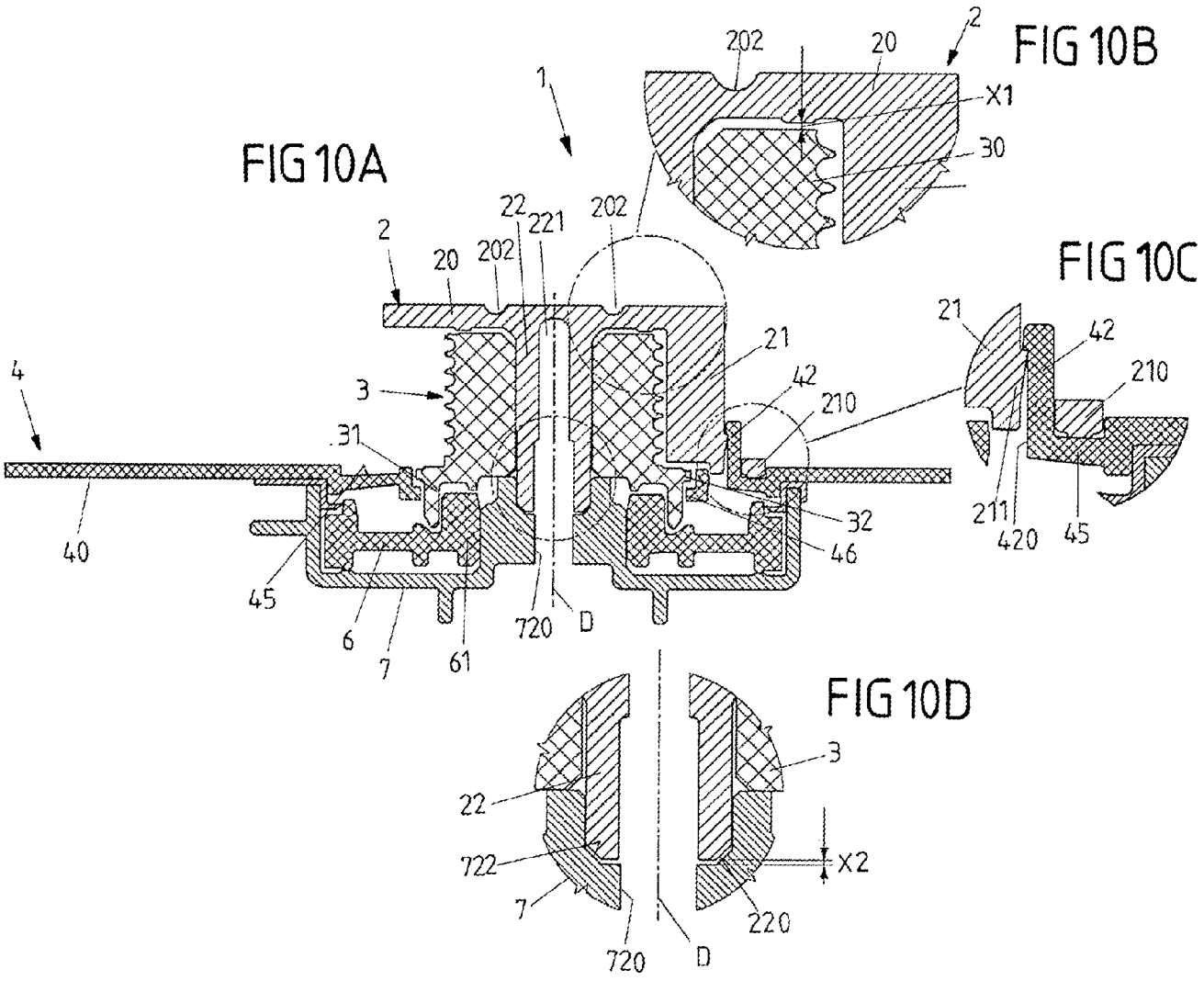
FIG. 10A shows a view of a further exemplary embodiment of a drive device in a cross-sectional view.
FIG. 10B shows an enlarged view in a first fragment according to FIG. 10A.
FIG. 10C shows an enlarged view in a second fragment according to FIG. 10A.
FIG. 10D shows an enlarged view in a third fragment according to FIG. 10A.

By contrast to the exemplary embodiment described above by means of FIGS. 1A, 1B to 9, the bearing element 22 in the case of an exemplary embodiment illustrated in FIGS. 10A to 10D and 11A to 11D is lengthened and by way of the end thereof engages in the bearing element 72 of the drive housing 7, such as can be seen, for example, from FIG. 10A and the enlarged view according to FIG. 10D.

FIGS. 10A to 10D herein show the drive device 1 in a first assembly position in which the cable exit housing 2, on the one hand, and the drive housing 7, on the other hand, are attached to the carrier element 4 but are not yet mutually braced by way of the fastening element 9. In this first assembly position, the cable exit housing 2 by way of the base portions 210 of the housing portions 21 thereof bear on the contact ring 45 of the carrier element 4 (cf. the enlarged view according to FIG. 10C), wherein a play X1 exists between the cable drum 3 and the base 20 (cf. the enlarged view according to FIG. 10B) and moreover a play X2 exists between the conical portion 220 on the end of the bearing element 22 and the centering engagement 722 on the bearing element 72 (cf. the enlarged view according to FIG. 10D).

Figures 11A, 11B, 11C, 11D:
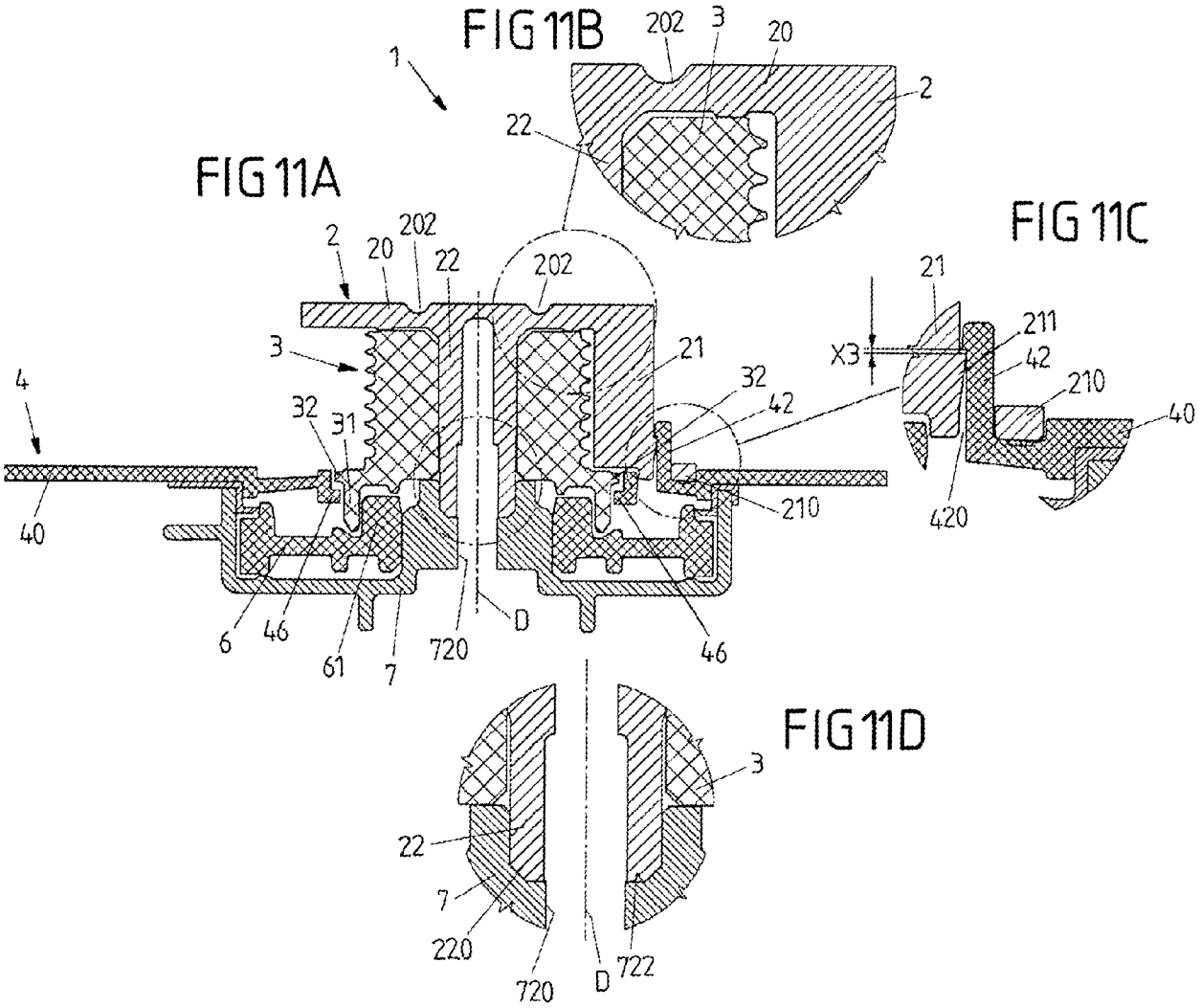
FIG. 11A shows the exemplary embodiment according to FIG. 10A in a braced state.
FIG. 11B shows an enlarged view of the assembly according to FIG. 11A in the first fragment.
FIG. 11C shows an enlarged view of the assembly according to FIG. 11A in the second fragment.
FIG. 11D shows an enlarged view of the assembly according to FIG. 11A in the third fragment.

When the cable exit housing 2 by way of the fastening element 9 is now braced axially in relation to the drive housing 7, the bearing element 22 on account thereof is drawn farther into the bearing element 72 and, on account thereof, the play X2 between the conical portion 220 of the bearing element 22 and the centering engagement 722 of the bearing element 72 is canceled, such as can be seen from the enlarged view according to FIG. 11B. This is performed while (slightly) deforming the base 20 of the cable exit housing 2, in particular at the predetermined breaking points 202, wherein the base portions 210 are also (slightly) deformed and, on account thereof, a play X3 is set in the axial direction between the latching element 211 of each housing portion 21 and the latching clearance 420 of the respective assigned positive-lock element 42 (FIG. 11C). Moreover, the play X1 between the base 20 and the cable drum 3 is largely canceled (cf. FIG. 11B) such that the cable drum 3 is held axially in a substantially play-free manner between the cable exit housing 2 and the bearing element 72 the drive housing 7, said cable drum 3 herein however being rotatable in a effortless manner on the bearing element 22.

The exemplary embodiment according to FIGS. 10A to 10D and 11A to 11D in functional terms is otherwise identical to the exemplary embodiment according to FIGS. 1A, 1B to 9, such that reference is to be made to the above.

An elimination of play as is the case in the exemplary embodiment according to FIGS. 10A to 10D and 11A to 11D by bracing the cable exit housing 2 in relation to the drive housing 7 can also be provided in the case of the exemplary embodiment according to FIGS. 1A, 1B to 9, such that the exemplary embodiments can also to this extent be functionally identical.

In the case of the exemplary embodiments explained above, the cable exit housing 2 by way of the housing portions 21 thereof is attached to a contact structure 45 on the area element 40 of the carrier element 4 and herein by way of the base portions 210 of the housing portions 21 engages in the positive-locking elements 42 that protrude in a rib-shaped manner on the carrier element 4. As can be derived from the enlarged view according to FIG. 14, the contact structure 45 forms a ring about the opening 41 molded in the carrier element 4, the cable drum 3 being operatively connected to the drive wheel 6 by way of said opening 41. The contact structure 45 is designed in the shape of a corrugation and has elevations 451 in the form of corrugation peaks that extend radially in relation to the rotation axis D, and depressions 452 in the form of radially extending corrugation troughs that lie between the elevations 451. The elevations 451 and the depressions 452 are successively lined up in an alternating circumferential manner about the rotation axis D and thus configure a periodic structure to which the cable exit housing 2 by way of the base portions 21 thereof can be attached.

Figure 14:
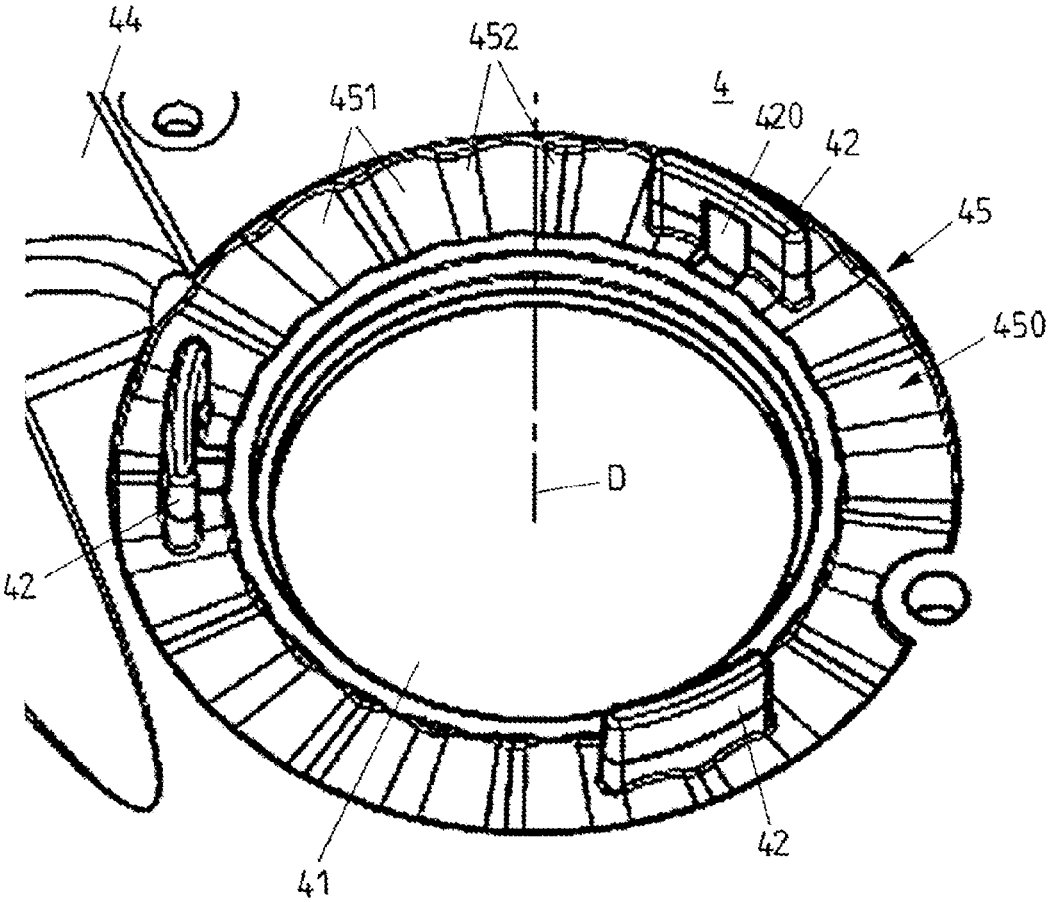
FIG. 14 shows an enlarged illustration of a contact structure on the carrier element for attaching the cable exit housing.

FIG. 14 shows the carrier element 4 in the region of the contact structure 45 on the side to which the cable exit housing 2 is to be attached. As can be seen in particular also from a comparison of FIGS. 1A and 1B, the corrugated contact structure 45 is molded in both sides of the carrier element 4 such that the material thickness (material wall thickness) remains substantially constant in the region of the contact structure 45. Material accumulations on the contact structure 45 are thus avoided, this potentially reducing any distortion on the contact structure 45 and thus minimizing deviations of the contact structure 45 from the nominal shape thereof.

The cable exit housing 2 by way of the housing portions 21 thereof is attached to the contact structure 45 in that the base portions 210 of the housing portions 21 are brought to bear on the contact structure 45. As can be seen from FIGS. 13A to 13F, the base portions 210 of the housing portions 21 have in each case a shaping which is adapted to the shaping of the contact structure 45. The base portions 210 thus have in each case three elevations 215, 216 having depressions lying therebetween, said depressions being capable of engaging in a positive-locking manner with the depressions 452 and elevations 451 of the contact structure 45.

The elevations 215, 216 of each base portion 210 can have identical heights (when viewed along the rotation axis D). However, it is also conceivable and possible for the centric elevation 216 to have a greater height than the external two elevations 215, for example. A (slight) elastic deformation thus arises on the base portions 210 when attaching the cable exit housing 2 to the contact structure 45, this potentially improving the absence of play of the cable exit housing 2 in relation to the carrier element 4.

In the case of the exemplary embodiment of the cable exit housing 2 according to FIGS. 13A to 13F, the base portions 210 of the housing portions 21 are in each case separated from a rear wall 213 of the assigned housing portion 21 by way a slot-shaped positive-lock opening 212. The positive-lock opening 212 (when viewed in the circumferential direction about the rotation axis D) extends along the entire width of the base portion 210, such that the base portions 210 are separated from the rear wall 213 along the entire width of said base portions 210.

The positive-lock opening 212 herein also extends into side walls 214 that are axially spaced apart from the base portion 210, this enabling a desired elasticity to be set on the base portion 210.

In the event of a deformation of the base portion 210 on account of pressure acting on the central elevation 216 it arises in particular by virtue of the positive-lock openings 212 that extend into the side walls 214 that the external elevations 215 are elastically drawn toward one another (along a circumferential direction about the rotation axis D). On account thereof, the engagement in the contact structure 45 can be improved at a favorable absence of play.

The exemplary embodiment according to FIGS. 1 to 9, in terms of the shaping of the base portions 210 of the housing portions 21, is identical to the exemplary embodiment of the cable exit housing 2 according to FIGS. 13A to 13F. As can be seen from a comparison of FIG. 5 and FIG. 13A, the exemplary embodiments of the cable exit housing 2 according to FIGS. 1 to 9 and FIGS. 13A to 13F differ (only) by way of the width of the slot-shaped positive-lock opening 212.

Different variants of the cable exit housing 2 for attaching to the contact structure 45 are fundamentally conceivable and possible.

Figure 15A:
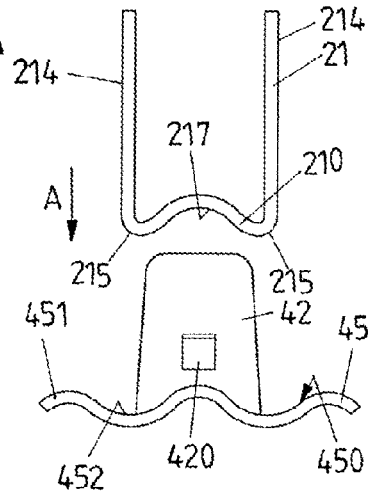
FIG. 15A shows a schematic illustration of an exemplary embodiment of a housing portion of the cable exit housing before being attached to a contact structure of the carrier element.
Figure 15B:
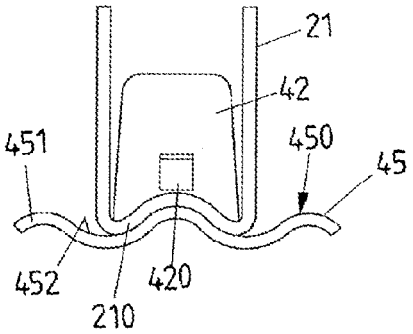
FIG. 15B shows the assembly according to FIG. 15A after attaching the housing portion to the contact structure.

For example, the base portion 210 of a housing portion 21 can be pre-shaped in such a manner, as is schematically illustrated in FIGS. 15A and 15B, that elevations 215 and depressions 217 are complementary to the depressions 452 and elevations 451 of the contact structure 45. In this case, the housing portion 21 by way of the base portion 210 thereof can be configured so as to be largely rigid. The base portion 210 when attaching the housing portion 21 to the contact structure 45 in an attachment direction A comes to bear in a positive-locking manner on the contact structure 45 without any (noticeable) deformation arising on the base portion 210.

Figure 16:
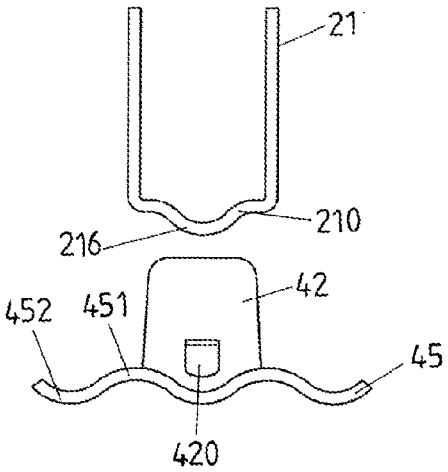
FIG. 16 shows a schematic view of another exemplary embodiment of a housing portion before being attached to the contact structure.

While the base portion 210 in the case of the exemplary embodiment according to FIGS. 15A and 15B has two external elevations 215 and one depression 217 lying therebetween, a centric elevation 216 is formed on the base portion 210 in the case of the exemplary embodiment according to FIG. 16. The base portion 210 in terms of the shaping thereof is again complementary to the contact structure 45.

Figure 17A:
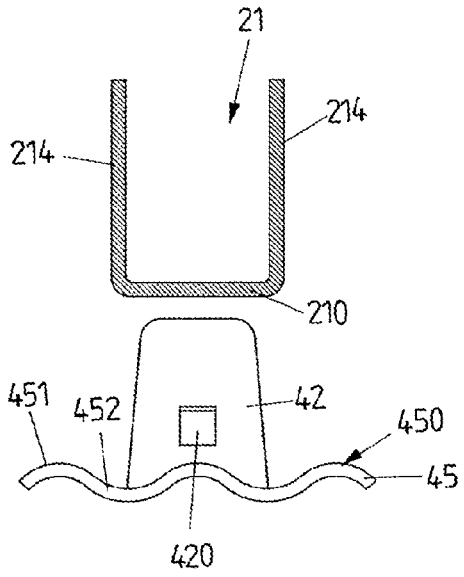
FIG. 17A shows a schematic view of yet another exemplary embodiment of a housing portion before being attached to the contact structure.
Figure 17B:
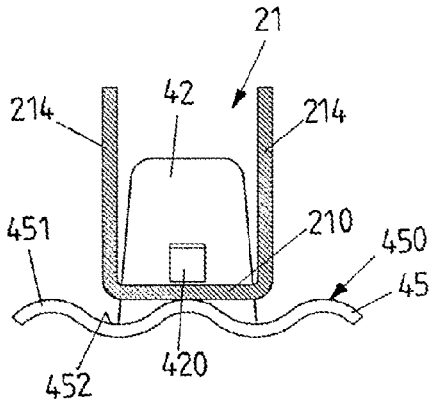
FIG. 17B shows the assembly according to FIG. 17A when being attached to the contact structure.
Figure 17C:
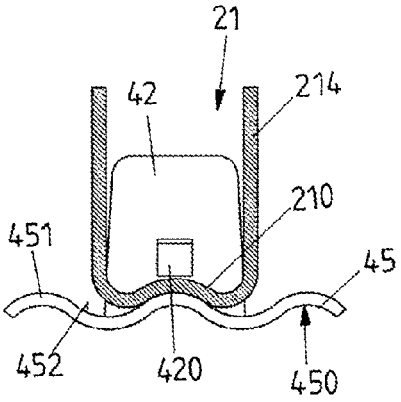
FIG. 17C shows the assembly according to FIGS. 17A and 17B in the attached position.

In the case of the exemplary embodiment according to FIGS. 17A to 17C, the base portion 210 of a housing portion 21 of the cable exit housing 2 is not pre-shaped but is made from an elastic material in such a manner that the shape of the base portion 210 can adapt so as to be complementary to the contact structure 45 when the cable exit housing 2 is attached to the carrier element 4. When the base portion 210 of a housing portion 21 is attached to an elevation 451 of the contact structure 45, the base portion 210 bulges in a corresponding manner and hugs the elevation 451 such that a favorable bearing of the cable exit housing 2 on the carrier element 4 is obtained in this way.

Figure 18:
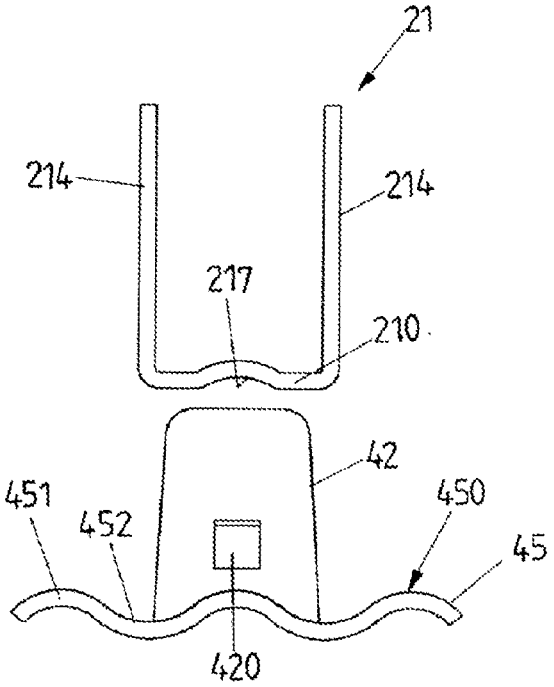
FIG. 18 shows a schematic view of yet another exemplary embodiment of a housing portion of the cable exit housing before being attached to the contact structure.

It is also conceivable and possible herein that a (slight) deformation is provided on the base portion 110, as is schematically illustrated in FIG. 18, in that a (small) depression 217 is formed on the base portion 210, for example. When being attached to the carrier element 4, an elevation 451 of the contact structure 45 engages in the pre-shaped depression 217, wherein the base portion 210 when being attached is further deformed and, on account thereof, hugs the contact structure 45.

Figure 19:
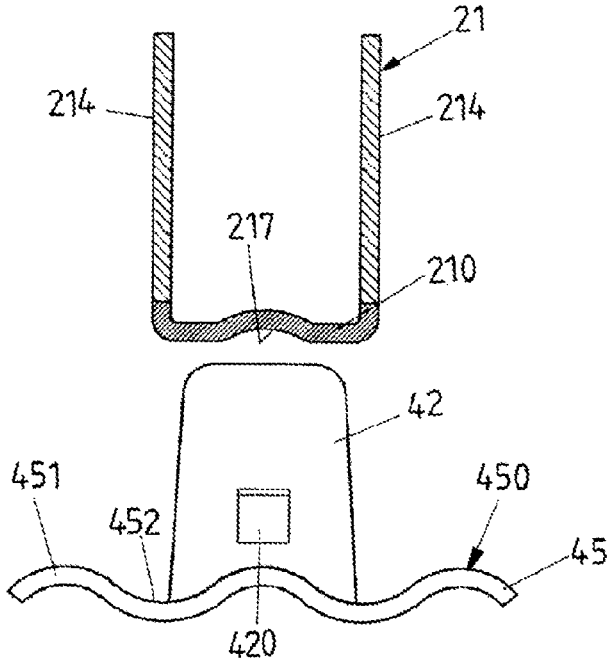
FIG. 19 shows a schematic view of yet another exemplary embodiment of a housing portion before being attached to the contact structure of the carrier element.

It is also conceivable and possible for one or a plurality of the housing portions 21 to be made from different materials, as is schematically illustrated in FIG. 19, for example by means of a bi-component injection-molding method. For example, the rear wall 113 and the side walls 214 of a housing portion 21 can thus be made from a comparatively hard material, while the base portion 210 is molded from a comparatively soft material having a low elasticity modulus. The housing portion 21 is thus particularly elastically deformable at the base portion 210 thereof, and can adapt to the shaping of the contact structure 45 where said housing portion 21 comes to bear on the contact structure 45.

A favorable bearing of the cable exit housing 2 on the carrier element 4 can be provided on account of the corrugated contact structure 45. The cable exit housing 2 herein can be attached to the carrier element 4 in different mutually rotated potions, specifically in three different rotary positions in the case of the exemplary embodiments illustrated (predefined by the number of positive-lock elements 42), wherein more discrete rotary positions can fundamentally also be provided.

The corrugated contact structure 45 moreover leads to a reinforcement on the circumferential periphery about the opening 41 in the carrier element 4. Conjointly with the play-free establishment of the cable exit housing 2 on the carrier element 4, this can reduce an excitation of vibrations on the carrier element 4 in the operation of the drive device 1.

The concept on which the solution is based is not fundamentally limited to the exemplary embodiments set forth above but can fundamentally also be implemented in an entirely different manner.

A drive device of the type described is in particular not limited to the use in a power window actuator but can also serve for adjusting another adjustment element, for example a sliding roof or the like, in a vehicle.

The drive device can be assembled in a simple manner, in particular while using a (single) axially braced fastening element. An assembly which can be simple and cost-effective paired with a reliable establishment of the cable exit housing and of the drive housing on the carrier element results in few assembly steps.

LIST OF REFERENCE SIGNS

1 Drive device
10 Cable
11 Guide rail
110, 111 Deflection
12 Entrainment element
13 Window glass
2 Cable exit housing
20 Base
200, 201 Structural element (reinforcement rib)
202 Recess (material weakening)
21 Housing portion
210 Base portion
211 Latching element
212 Positive-lock opening (slot opening)
213 Rear wall
214 Side walls
215, 216 Elevation
217 Depression
22 Bearing element (bearing dome)
220 Centering cone
221 Opening
23 Securing element
3 Cable drum
30 Body
300 Cable channel
31 Ring gear
310 Toothing
32 Bearing element
4 Carrier element (apparatus carrier)
40 Area portion
41 Opening
42 Positive-lock element
420 Latching clearance
43 Positive-lock element
44 Molding
440 Molding
45 Contact ring
450 Contact structure (corrugated structure)
451 Elevation (corrugation peak)
452 Depression (corrugation trough)
46 Bearing ring
5 Sealing element
50 Annular seal
51 Engagement portion
52 Curved portion
6 Drive wheel
60 Body
600 External toothing
61 Connecting wheel
610 Toothing
62 Opening
7 Drive housing
70 Housing case
71 Fastening installation (engagement bush)
710 Positive-lock opening
72 Bearing element (bearing dome)
720 Opening
721 Engagement opening
722 Centering engagement
73 Motor case
74 Worm housing
75 Housing cover
76 Electronics housing
760 Circuit board
761 Housing plate
762 Plug connector
8 Motor unit
80 Electric motor
800 Drive shaft
81 Drive worm
82 Bearing
9 Fastening element
90 Shank
91 Head
A Attachment direction
D Rotation axis
X1, X2, X3 Play

The invention claimed is:

1. A drive device for an adjustment installation for adjusting a vehicle part, including a power window actuator, comprising a carrier element;

a cable drum;

a cable exit housing configured to be disposed on the carrier element and supporting the cable drum for rotation about a rotational axis, the cable exit housing including at least one housing portion attachable to the carrier element;

a motor unit for electromotively driving the cable drum; and a drive housing disposed on a side of the carrier element facing away from the cable exit housing, the drive housing mounting a drive wheel operatively connected to the motor unit;

wherein the carrier element includes a contact structure having a plurality of elevations and depressions that are successively lined up and are mutually disposed in an alternating manner, the at least one housing portion of the cable exit housing being attachable to the contact structure by a base portion of the cable exit housing;

wherein the contact structure extends annularly about the rotational axis, wherein the plurality of elevations and depressions are aligned to alternate along a circumferential direction about the rotational axis.

2. The drive device as claimed in claim 1, wherein the elevations and depressions form a corrugated structure.

3. The drive device as claimed in claim 1, wherein the base portion has a profile that is complementary to that of the contact structure.

4. The drive device as claimed in claim 1, wherein the base portion has at least one elevation that is complementary to a depression of the contact structure, and/or at least one depression that is complementary to an elevation of the contact structure.

5. The drive device as claimed in claim 1, wherein the base portion at least in portions is elastic and when being attached to the contact structure is elastically deformed such that the base position comes to bear in a positive-locking manner on the contact structure.

6. The drive device as claimed in claim 1, wherein the at least one housing portion in a first region is made from a first material having a first elasticity modulus and in a second region, including the base portion, is made from a second material having a second elasticity modulus, lower than the first.

7. The drive device as claimed in claim 1, further comprising a positive-lock element that is radially spaced apart from the rotational axis and that is disposed on one of the carrier element and the base portion, wherein the positive-lock element is configured to engage in a positive-lock opening on the other of the carrier element and the base portion.

8. The drive device as claimed in claim 7, wherein the positive-lock opening is formed by an arcuate slot opening that extends about the rotation axis.

9. The drive device as claimed in claim 7, wherein the positive-lock opening is formed in the base portion that is attachable in a planar manner to the contact structure and extends into a side wall of the at least one housing portion, the side wall projecting radially from a rear wall and extending from the base portion so as to be parallel to the rotational axis.

10. The drive device as claimed in claim 1, wherein the base portion includes elevations and at least one depression that mesh with the elevations and the depressions of the carrier element to connect the base portion to the contact structure.

11. A drive device for an adjustment installation for adjusting a vehicle part, including a power window actuator, comprising a carrier element;

a cable drum;

a cable exit housing configured to be disposed on the carrier element and which mounts the cable drum to be rotatable about a rotational axis and, which by way of at least one housing portion, is attachable to the carrier element;

a motor unit for electromotively driving the cable drum; and a positive-lock element that is radially spaced apart from the rotational axis and is disposed on the carrier element, wherein the positive-lock element is configured to engage in a positive-lock opening on the base portion;

wherein the carrier element includes a contact structure having a plurality of elevations and depressions that are successively lined up and are mutually disposed in an alternating manner, the at least one housing portion of the cable exit housing by way of a base portion of the cable exit housing being attachable to the contact structure;

wherein the positive-lock element is disposed on the carrier element, projects from the contact structure so as to be parallel to the rotational axis, and engages in the positive-lock opening on the base portion of the at least one housing portion.

12. The drive device as claimed in claim 11, further comprising a drive housing that is disposed on a side of the carrier element that faces away from the cable exit housing and that mounts a drive wheel operably connected to the motor unit.

13. A drive device for an adjustment installation for adjusting a vehicle part, including a power window actuator, comprising a carrier element;

a cable drum;

a cable exit housing configured to be disposed on the carrier element and which mounts the cable drum so as to be rotatable about a rotational axis and, which by way of at least one housing portion, is attachable to the carrier element;

a motor unit for electromotively driving the cable drum; and a drive housing that is disposed on a side of the carrier element that faces away from the cable exit housing and that mounts a drive wheel operatively connected to the motor unit;

wherein the carrier element includes a contact structure having a plurality of elevations and depressions that are successively lined up and are mutually disposed in an alternating manner, the at least one housing portion of the cable exit housing by way of a base portion of the cable exit housing being attachable to the contact structure;

wherein the cable exit housing has a first bearing element for mounting the cable drum, and the drive housing has a second bearing element for mounting the drive wheel, wherein the cable exit housing and the drive housing are fastened to one another by way of a fastening element that acts between the first bearing element and the second bearing element.

14. The drive device as claimed in claim 13, wherein one of the bearing elements has a conical portion, and the other of the bearing elements has a centering engagement for interacting with the conical portion in order for the first bearing element and the second bearing element to be mutually centered.

15. The drive device as claimed in claim 14, wherein in a first assembly position in which the cable exit housing and the drive housing are disposed on the carrier element but are not yet mutually axially braced by way of the fastening element, the conical portion and the centering engagement have mutual axial play; and in a second assembly position in which the cable exit housing and the drive housing are mutually axially braced by way of the fastening element, the conical portion and the centering engagement bear on one another.

16. The drive device as claimed in claim 13, wherein the cable exit housing has a base from which the first bearing element projects, wherein the base, when bracing the cable exit housing in relation to the drive housing, is at least in portions elastically deformable.

17. The drive device as claimed in claim 16, wherein the base has at least one structural element in which a recess for providing a predetermined breaking point is formed in at least one location.

18. The drive device as claimed in claim 17, wherein the structural element is formed by a reinforcement rib.

* * * * *